United States Patent [19]

Vermeer et al.

[11] 3,936,917

[45] Feb. 10, 1976

[54] AUTOMATIC GATE LOADING CONTROL FOR STUFFER BOX TEXTURING MACHINE

[75] Inventors: Dick Charles Vermeer, Chester; Raymond Joseph Biron, Colonial Heights, both of Va.

[73] Assignee: Allied Chemical Corporation, Petersburg, Va.

[22] Filed: May 19, 1975

[21] Appl. No.: 578,588

[52] U.S. Cl. ..... 28/1.7; 28/72.14

[51] Int. Cl.[2] ..... D02G 1/12

[58] Field of Search ..... 28/1.6, 1.7, 72.14

[56] References Cited

UNITED STATES PATENTS

| | | | |
|---|---|---|---|
| 3,166,821 | 1/1965 | Furlong | 28/1.7 |
| 3,528,149 | 9/1970 | Tambini et al. | 28/1.7 |
| 3,777,338 | 12/1973 | Vermeer et al. | 28/1.7 |
| 3,859,695 | 1/1975 | Erickson | 28/1.7 |

*Primary Examiner*—Louis K. Rimrodt
*Attorney, Agent, or Firm*—Richard A. Anderson

[57] ABSTRACT

In stuffer box crimping of yarn, yarn is forced into a crimping chamber to form a wad and discharged with a discharge control being varied in response to sensing the position of the wad at the exit of the crimping chamber. The improvement of this invention comprises sensing the position of the yarn wad in the crimping chamber by issuing at least one jet of a fluid aligned to issue across the exit of crimping chamber and receiving the jet in an enlarged orifice communicating with a pressure sensor controller so the yarn wad unfolding point is sensed by interrupting the jet of fluid to thereby regulate the discharge controller with the pressure sensor controller.

20 Claims, 2 Drawing Figures

AUTOMATIC GATE LOADING CONTROL FOR STUFFER BOX TEXTURING MACHINE

BACKGROUND OF THE INVENTION

This invention relates to stuffer crimping of textile strands and is particularly concerned with a control method and apparatus for discharging the yarn from the crimping chamber. Control of discharge from a stuffer box during crimping of textile strands is known in the art in U.S. Pat. No. 3,859,695 and U.S. Pat. No. 3,528,149 . These patents and some of the patents cited as references thereto, teach sensing pressure or using photo cells to sense position or density of a compacted mass or wad of yarn as it unfolds from the crimping chamber and controlling the gate pressure at the exit of the crimping chamber. U.S. Pat. No. 3,777,338 teaches sensing yarn plug location in a stuffer tube of a steam jet texturing device by issuing a jet of fluid and sensing back pressure on the jet of fluid as it impinges on the yarn. The cited references to U.S. Pat. No. 3,777,338 also teach various means of sensing plug end control.

The prior art stuffer box crimping process for synthetic yarn comprises forcing the yarn into a crimping chamber to form a compressed mass or wad of the yarn in the crimping chamber, with the chamber having a pressure regulated discharge means at the outlet and discharging yarn from the crimping chamber. Controlling the discharge of the yarn from the chamber by regulating the pressure on the discharge means by varying the regulating pressure in response to sensing position of the wad of yarn at the exit of the crimping chamber and regulating the pressure with a pressure sensor controller is also known.

The prior art apparatus for stuffer box crimping of synthetic yarns comprises means to force the yarn into a crimping chamber having a regulated discharging means and a pressure sensor controller to regulate the position of the wad of the yarn in the crimping chamber by regulating pressure on the discharge means.

SUMMARY OF THE INVENTION

The process improvement of this invention comprises sensing the position of the wad of the yarn of the chamber by issuing at least one jet of a fluid, with the jet aligned to issue across the exit of the crimping chamber and receiving the jet of fluid in an enlarged orifice communicating with the pressure sensor controller, so that the presence of the wad of the yarn is sensed by interrupting the jet of fluid by the wad, thereby changing pressure in the enlarged orifice to regulate the discharge means through the pressure sensor controller.

The apparatus improvement comprises at least one port to issue a jet of fluid, the port communicating with a source of pressure, and the port aligned to issue the jet across the exit of the crimping chamber, and the jet directed into an enlarged port to receive the jet of fluid, the enlarged port communicating with the pressure sensor controller, so that the wad of the yarn is sensed by interrupting of the jet of fluid by the wad, thereby changing pressure in the enlarged port to regulate the discharge means through the pressure sensor controller. Preferably, the ratio of the diameter of the orifice or port of the jet issuing the fluid (emittor) to the diameter of the orfice or port receiving the jet of fluid (collector) should be between about 0.1 and 0.01. Preferably, the emittor or the jet issuing the fluid should be constructed to emit a conical fluid stream, opening toward the enlarged orifice. The stream should have an included angle between about 1° and about 15°.Also it is preferred that the enlarged orifice (collector) is a concave surface within the opening, more preferably parabolic but spherical is acceptable. The enlarged orifice or collector port should communicate through a short conduit exiting into the center of a chamber extending across the diameter of the port. Preferably, the volume of the chamber communicating with the enlarged opening should be between about 0.1 and 1 cubic inch. The apparatus of this invention can be used to detect the presence of a mass or wad of yarn at a distance up to 3 inches. This is many times the distance possible with prior art fluid emittor type devices.

DESCRIPTION OF THE PREFERRED EMBODIMENTS

Figure 1:
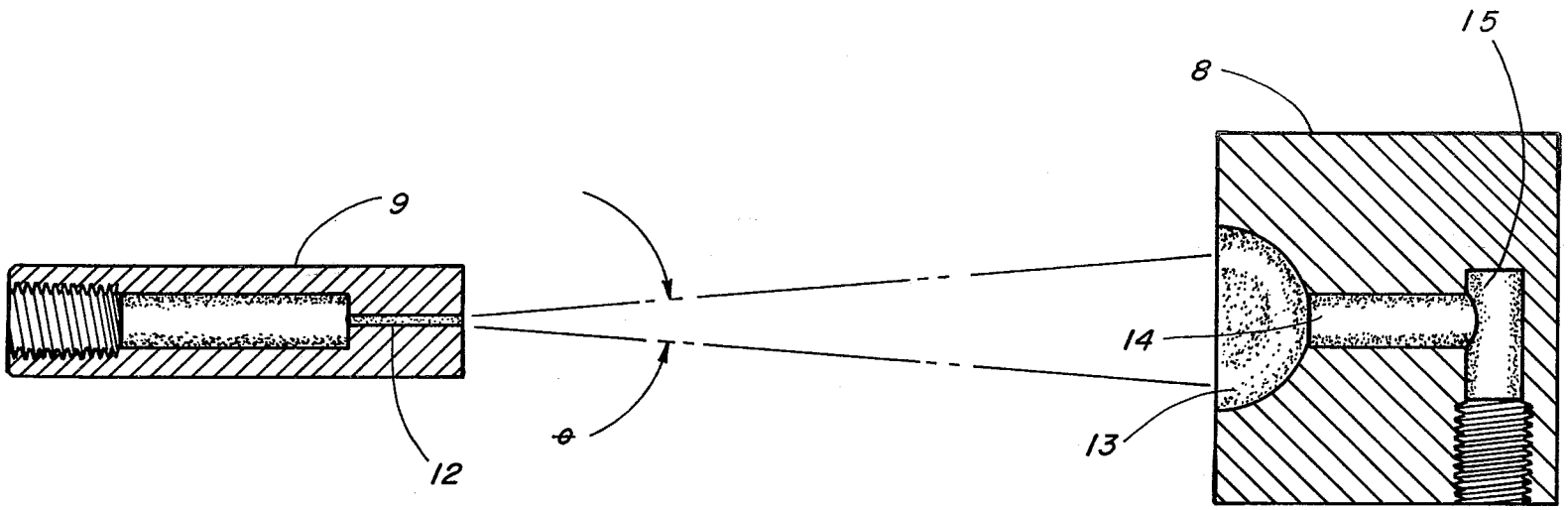
FIG. 1 is a schematic showing a cross-section of the issuing jet and a cross-section of the enlarged orifice aligned to receive the jet of fluid.

Referring to FIG. 1, the issuing jet 9 which can also be called the emittor issues a jet of fluid, such as air or steam through the channel 12 which has an outlet port or orifice as shown. The fluid is emitted from this port or orifice at one angle $\phi$. The jet of fluid is received at the orifice or port 13 in the receiver 8 which also has chamber 14 communicating with enlarged chamber 15. The preferred range of angle $\phi$ is between about 1° and 15°. Enlarged opening 15 is a volume of between about 0.1 and 1 cubic inch. The ratio of the diameter of the issuing port of channel 12 (emittor) to the diameter of the port receiving the jet of fluid (collector) 13 should be between about 0.1 and about 0.01. The distance between emittor and receiver can be up to 3 inches.

Figure 2:
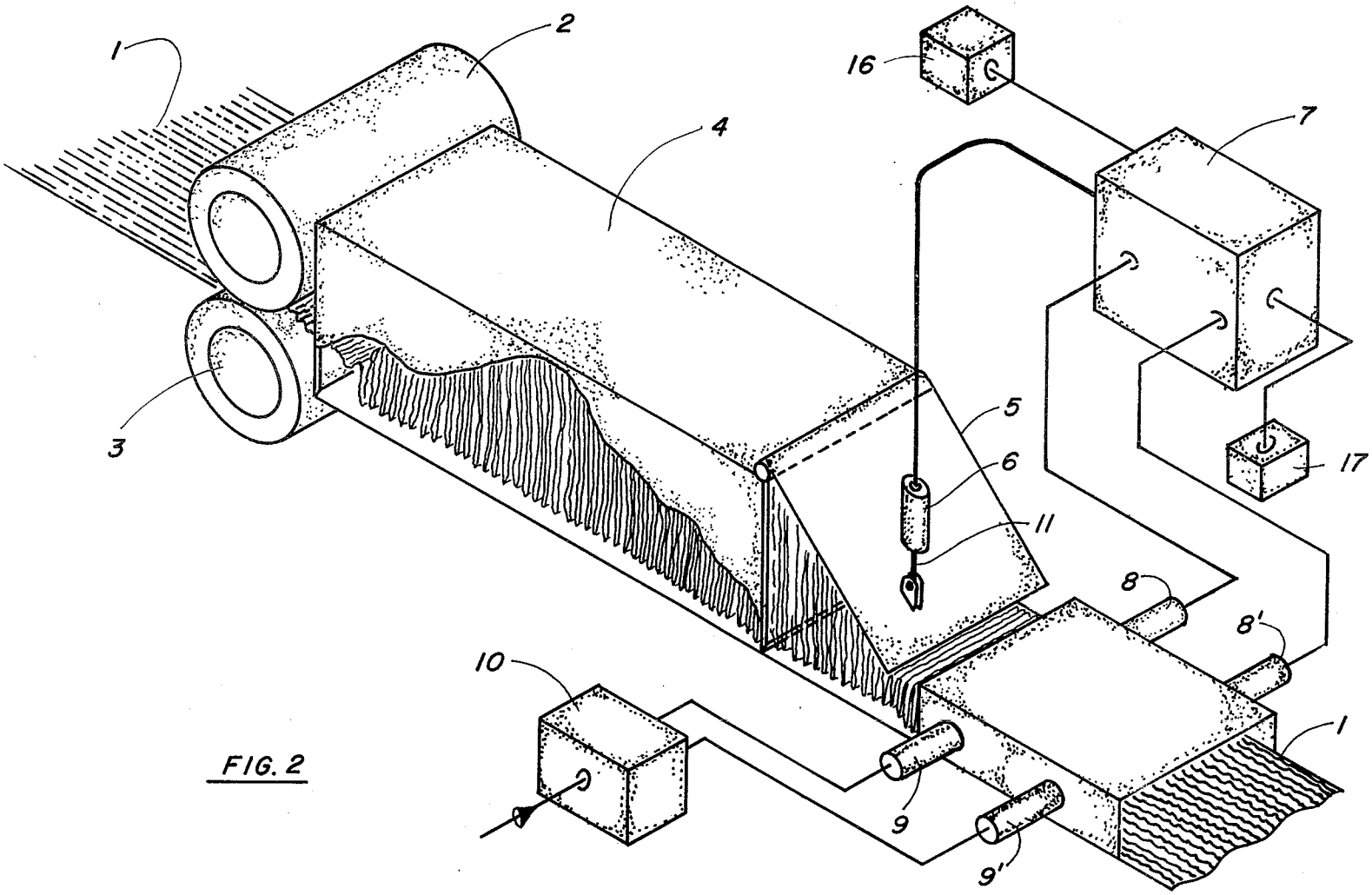
FIG. 2 is an isometric schematic showing the use of the sensing device to control the discharge of yarn from a typical stuffer box.

Referring to FIG. 2, issuing jets 9 and 9' are shown aligned across the exit of a stuffer box 4 and also aligned to be collected by receiving ports 8 and 8' to sense the location of the wad of yarn 1 exiting stuffer chamber 4. Uncrimped yarn 1 is fed by nip rolls 2 and 3 into stuffer chamber 4 which is filled with high temperature fluid such as steam or hot air and is compressed and compacted by buckling into a wad which imparts crimp to yarn. Yarn exits stuffer chamber 4 under control gate 5 which is controlled by pneumatic or hydraulic cylinder 6 exerting force on rod 11. The pressure exerted by hydraulic or pneumatic cylinder 6 is controlled by pressure sensor controller 7 which senses pressure sensed in port 13, shown in FIG. 1, receiving the jet of fluid by collectors 8 and 8'. Fluid under pressure is supplied to issuing jets 9 and 9' from source 10. Pressure sensor controller 7 receives electrical power from source 16 and instrument air from source 17.

The apparatus and process of this invention was used on a conventional multi-end stuffer box crimping apparatus as shown in FIG. 1, to produce about 16,000 pounds of steam-crimped nylon yarn. Carpet made from the yarn was found acceptable and similar to commercial yarn of the same type. Based on the ratio of total of the time the machine was actually running to total actual chronological time of the run, the machine efficiency for the week before the use of this invention was 94.7 percent, and for the week after 94.8 percent, but improved to 97.1 percent during use of this invention.

We claim:

1. In a stuffer box crimping process for synthetic yarn comprising forcing said yarn into a crimping chamber to form a wad of said yarn in said crimping chamber, said chamber having a pressure regulated discharge means at the outlet thereof, and discharging said yarn from said crimping chamber, and controlling said discharge of said yarn from said chamber by regulating said pressure on said discharge means, said regulating pressure being varied in response to sensing position of said wad of said yarn at the exit of said crimping chamber and regulating said pressure with a pressure sensor controller, the improvement comprising sensing said position of said wad of said yarn in said crimping chamber by issuing at least one jet of fluid, said jet aligned to issue across the exit of said crimping chamber, and receiving said jet of fluid in an enlarged orifice communicating with said pressure sensor controller, so that the presence of said wad of said yarn is sensed by interrupting said jet of fluid by said wad, thereby changing pressure in said enlarged orifice to regulate said discharge means through said pressure sensor controller.

2. The process of claim 1 wherein the ratio of the diameter of the orifice of the jet issuing said fluid to the diameter of the orifice receiving the jet of said fluid is between about 0.1 and 0.01.

3. The process of claim 1 wherein a channel leading to said orifice issuing said jet of fluid is constructed to emit a conical fluid stream, opening toward said enlarged orifice.

4. The process of claim 3 wherein the included angle of the conical fluid is between about 1° and about 15°.

5. The process of claim 1 wherein the enlarged orifice is a concave surface.

6. The process of claim 5 wherein said concave surface is parabolic.

7. The process of claim 5 wherein said concave surface is spherical.

8. The process of claim 1 wherein said enlarged orifice communicates through a short conduit to a cylindrical chamber extending across the diameter of said enlarged orifice.

9. The process of claim 8 wherein the volume of said chamber communicating with said enlarged opening is between the about 0.1 and 1.0 cubic inch.

10. The process of claim 2 wherein a channel leading to said issuing orifice is constructed to emit a conical fluid stream, opening toward said enlarged orifice at an included angle of between about 1° and 15°, and said enlarged orifice is a parabolic surface, and said enlarged orifice communicates through a short conduit exiting into the center of a cylindrical chamber extending across the diameter of said opening and said chamber has a volume of between about 0.1 and 1.0 cubic inch.

11. In an apparatus for stuffer box crimping of synthetic yarn comprising means to force said yarn into a crimping chamber having a regulated discharge means, and a pressure sensor controller to regulate the position of a wad of said yarn in said crimping chamber by regulating pressure on said discharge means, the improvement comprising at least one port to issue a jet of fluid, said port communicating with a source of pressure, said port aligned to issue said jet across the exit of said crimping chamber and said jet directed into an enlarged port to receive said jet of fluid, said enlarged port communicating with said pressure sensor controller, so that said wad of said yarn is sensed by interruption of said jet of fluid by said wad, thereby changing pressure in said enlarged port to regulate said discharge means through said pressure sensor controller.

12. The apparatus of claim 11 wherein the ratio of the diameter of the port of the jet issuing said fluid to the diameter of the port receiving said jet of said fluid is between about 0.1 and 0.01.

13. The apparatus of claim 11 wherein said issuing port has a channel constructed to emit a conical fluid stream, opening toward said enlarged orifice.

14. The apparatus of claim 13 wherein the included angle of the conical fluid stream is between about 1° and about 15°.

15. The apparatus of claim 11 wherein said enlarged port is a concave surface within the opening.

16. The apparatus of claim 15 wherein said concave surface is parabolic.

17. The apparatus of claim 15 wherein said concave surface is spherical.

18. The apparatus of claim 11 wherein said collector port communicates through a short conduit exiting into the center of a cylindrical chamber extending across the diameter of said port.

19. The apparatus of claim 18 wherein the volume of said chamber communicating with said enlarged port is between about 0.1 and 1.0 cubic inch.

20. The apparatus of claim 12 wherein said port issuing said jet of said fluid has a channel constructed to emit a conical fluid stream, opening toward said enlarged orifice at an included angle of between about 1° and about 15°, said enlarged port opens into a parabolic surface, said enlarged port communicates through a short conduit existing into the center of the cylindrical chamber extending across the diameter of said port, and said chamber has a volume of about 0.1 to 1 cubic inch.

* * * * *

UNITED STATES PATENT OFFICE
CERTIFICATE OF CORRECTION

PATENT NO. : 3,936,917

DATED : February 10, 1976

INVENTOR(S) : Dick Charles Vermeer et al.

It is certified that error appears in the above-identified patent and that said Letters Patent are hereby corrected as shown below:

Column 3, line 40, insert --stream-- after "fluid".

Column 3, line 53, delete "the" after "between".

Column 4, line 55, "existing" should read --exiting--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*